United States Patent [19]

Vineberg

[11] 4,193,150

[45] Mar. 18, 1980

[54] ELEVATED MATTRESS

[76] Inventor: Arthur Vineberg, 3170 Delavigne, Montreal, Quebec, Canada

[21] Appl. No.: 926,634

[22] Filed: Jul. 21, 1978

[30] Foreign Application Priority Data

Aug. 4, 1977 [CA] Canada ..... 284083

[51] Int. Cl.[2] ..... A47G 9/00; A61G 7/06; A47C 27/14

[52] U.S. Cl. ..... 5/431; 5/436; 5/481; 297/DIG. 1

[58] Field of Search ..... 5/355, 345 R, 357, 337, 5/338, 327 R, 327 B, 434, 436, 443, 446, 431, 481; D6/201; 297/DIG. 1; 128/68, 70

[56] References Cited

U.S. PATENT DOCUMENTS

| | | | |
|---|---|---|---|
| 433,905 | 8/1890 | Muller | 5/355 |
| 3,378,861 | 4/1968 | Lousberg | 5/327 R |
| 3,389,411 | 6/1968 | Emery | 5/339 |
| 3,939,508 | 2/1976 | Hall et al. | 5/355 |

FOREIGN PATENT DOCUMENTS

| | | | |
|---|---|---|---|
| 1355477 | 2/1964 | France | 5/327 R |

*Primary Examiner*—Alexander Grosz
*Attorney, Agent, or Firm*—Alan Swabey

[57] ABSTRACT

An auxiliary elevated wedge-shaped mattress of a resilient open cell synthetic resin foam having a sloping surface long enough to give support to the head, neck and thorax of a reclining patient with his legs supported by the horizontal mattress.

3 Claims, 4 Drawing Figures

ELEVATED MATTRESS

This invention relates to an elevated mattress for placing on the top of a conventional mattress for elevating the head and thorax of a patient, particularly one suffering from hiatus hernia or heart failure.

A standard way of providing elevation for such patients is to raise the head of the bed by placing a four inch block under it. This has the disadvantage that not only the head and thorax of the patient are at an angle to the horizontal, but so are the legs. This results in the undesirable flow of blood from the upper part of the body to the legs.

The present invention overcomes this problem and at the same time provides a convenient way of elevating the upper part of a reclining patient's body.

The invention provides an auxiliary mattress of synthetic resin foam of calibrated indentation load deflection (ILD) having a regularly sloping load-carrying surface on which the patient reclines. A general principle of the mattress is that the head, neck and thorax of the patient are elevated to the same angle achieved by raising the head of the bed a commensurate distance, but without having the legs hang down. The elevated mattress of the invention is normally placed directly on top of the normal mattress, with a mattress cover and sheet covering both mattresses. A conventional pillow is normally provided for the patient's head. The mattress body is cut from a foam block so that its surfaces are of raw foam providing a frictional resistance so that it will not slip on the surface supporting it.

The elevated mattress is wide enough to cover the normal mattress on the top of which it is placed. It has a thickness from about 6⅛" down to about 5⅞" at the head end and, at the foot, is thick enough to provide a perceptible step up from the normal mattress, for example, in the neighbourhood of one-half inch. The length will depend on the height of the particular patient from his buttocks, so that the foam extends as far as the crease in the buttocks and the patient will not slip down when lying on the elevated mattress.

The consistency of the foam body of the auxiliary mattress is such that its deflection under the weight of a reclining patient would be within the range from about 23% to about 27%, preferably about 25%.

The calibrated indentation load deflection of the body material of the elevated mattress is preferably from 20 to 26 pounds of force per 50 square inches producing a 25% deflection on a sample of size 15 inches by 15 inches by 4 inches. The weight per unit volume of the foam is preferably within the range from about 2.65 to about 2.90 pounds per cubic foot.

The invention will now be described in more detail by reference to the accompanying drawings which illustrate a preferred embodiment, and in which.

Figure 1:
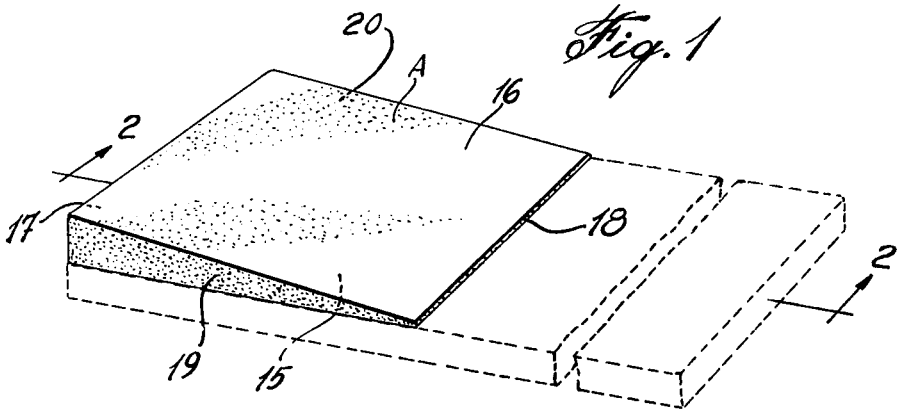
FIG. 1 is a perspective view of an elevated mattress according to the invention.

Referring more particularly to FIG. 1, the preferred mattress A is made up of a wedge-shaped body of polyurethane foam of calibrated resilience. The body has a base surface 15, a load-carrying surface 16 sloping from a deep head end surface 17 to a shallow foot end surface 18, and side surfaces 19 and 20. The surfaces 17 and 18 are preferably perpendicular to the surface 15.

Figure 2:
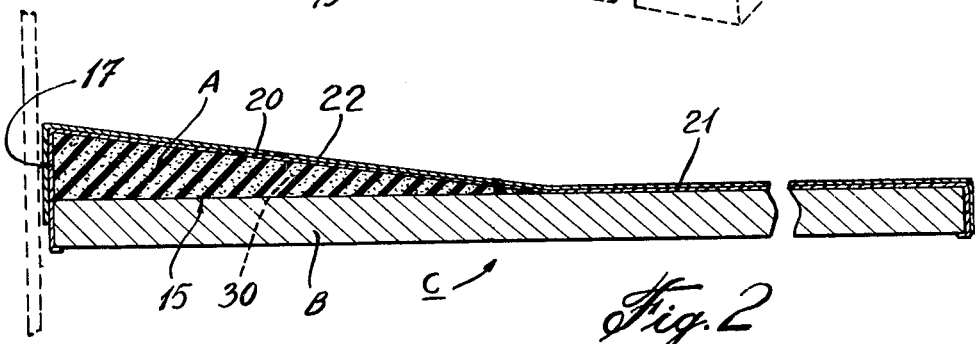
FIG. 2 is a vertical cross-section through a hospital bed equipped with a normal mattress and bed clothes, and with the elevated mattress of FIG. 1 in operative position.

The operative position of the mattress in use is shown in FIG. 2. It is placed directly over a normal mattress B, lying on the springs of a hospital bed C. The mattress A covers part of the length of the mattress B and leaves part of the latter free to support the patient's legs. The mattress A and the free surface of the mattress B are enveloped by a mattress cover 21 and a sheet 22 in the same way as a normal mattress would be covered, were no special mattress A employed.

Generally speaking, the surface 15 will be of the same width as the normal mattress, usually about 39 inches and has a length of from 32 inches to 42 inches depending on the height of the patient. For the short patient a 32 to 34 inch length is preferred, the average patient a 38 inch length and the tall patient a 42 inch length. The surface 17 may vary from about 6⅛" down to about 5⅞" in height and the surface 18 is sufficiently high to provide a perceptiable step up from the mattress B, for example, in the neighbourhood of one-half inch. The surface 16 slopes regularly from the top of the surface 17 to the top of the surface 18.

Figure 3:
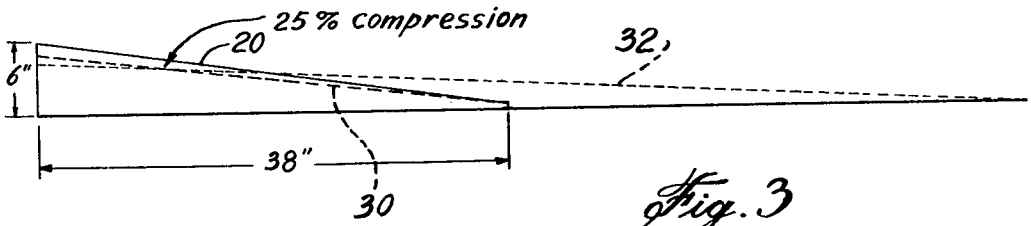
FIG. 3 is a diagrammatic showing of the deflection of the elevated mattress under pressure of a reclining patient.

As shown in FIG. 3, the angle between the surface 20 and the horizontal is considerably more obtuse than that of the surface of the ordinary mattress on the bed when the head of the bed is raised four inches.

The body A is entirely of open cell synthetic resin foam cut from a block so that the surfaces are free of skin. The base surface 15 thus offers frictional resistance to slipping. Such material should be supportive yet resilient, for example, such that the body of the elevated mattress is deflectable from about 23% to about 27%, preferably from about 25%, under the weight of a reclining patient.

FIG. 3 demonstrates the deflection of an elevated mattress, according to the invention, as compared with the position of the surface of a normal mattress, where the bed is raised the conventional four inches from the horizontal at the head end. The dotted lines 32 show the position of the surface of the normal mattress. The dash lines 30 show the approximate position of the deflected elevated mattress. In the example, the elevated mattress A is 38 inches long and 6 inches high at the head end and rests on a horizontal surface. For a 42 inch long mattress A, a preferred height at the head end would be about 6⅛ inches to achieve a comparable deflection and for a 32 inch long mattress the preferred height at the head end would be about 5⅞ inches to achieve a comparable deflection.

The density of the material from which the elevated mattress is made is preferably within the range from about 2.65 to about 3 pounds per cubic foot with an indentation load deflection from about 20 to about 26 pounds of force per 50 square inches to produce a 25% deflection when measured on a sample 15 inches by 15 inches by 4 inches in accordance with tests performed according to ASTM D 1564/71. An example of a specific preferred material is the flexible polyurethane foam Grade 2723 HW1 known as "Neocor" (trade mark). The specification (Revision Date Nov. 1, 1975) of this foam by its supplier, Monsanto Canada Limited, is as follows:

| | | | |
|---|---|---|---|
| DENSITY (CORE) | weight per unit volume | lbs.per cu.ft. | 2.65–2.90 |
| TENSILE STRENGTH | breaking strength | lbs.per sq.in. | 12 min. |
| ELONGATION | ultimate elongation | percent | 100 min. |
| TEAR RESISTANCE | tear strength | lbs.per inch thickness | 1.2 min. |
| COMPRESSION SET | method B 75% deflection % loss on original thickness | percent | 10 max. |
| RESILIENCE | ball rebound | percent | 60 min. |
| INDENTATION LOAD DEFLECTION (ILD) | method A 25% deflection sample size 15"33 15"× 4" | lbs.force per 50 sq.inches | 20–26 |
| MODULUS | ratio of 65% to 25% ILD Values | | 2.5 min. |
| HYSTERESIS | ratio of 25% return ILD value to original 25% ILS | percent | 80 min. |
| FATIGUE | procedure A static fatigue % loss of load | percent | 20 max. |

All tests were performed to ASTM D 1564-71, unless otherwise specified. Test samples are of trimmed material, free of skin, representative of the foam block.

Figure 4:
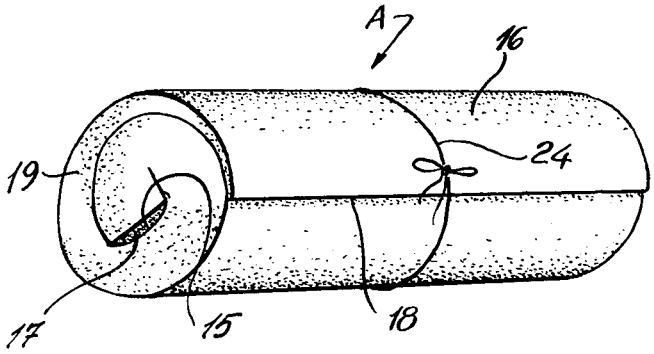
FIG. 4 is a perspective view showing the elevated mattress of the previous Figures rolled up for carriage or storing.

The synthetic resin foam material from which the elevated mattress is made may be rolled up for carrying or storage as shown in FIG. 4.

The embodiments of the invention in which an exclusive property or privilege is claimed are defined as follows:

1. An auxiliary elevated mattress, comprising, a one piece wedge-shaped integral homogeneous supportive body entirely of open cell resilient synthetic resin foam of which the indentation load deflection (ILD) is within the range from about 20 to about 26 based on the pounds of force for a 25% deflection in pounds force per 50 sq. inches in a sample of a size 15 inches by 15 inches by 4 inches, said body having, extending from a head end to a foot end, a planar rectangular base surface of which the length is in the range from about 32 inches to about 42 inches, and an uninterrupted planar load-receiving surface diverging therefrom at an acute angle, a major planar head end surface having a height from about 6½ to about 5⅞ inches extending from the base surface to the load-bearing surface and a minor foot end surface having a height not greater than about one-half inch extending perpendicularly from the base surface to the load-bearing surface, the base and load-receiving surfaces having substantially the width of a normal mattress, the length and inclination of the load-receiving surface being such as to support the head, neck and thorax of a patient reclining on the mattress with the crease in his buttocks near the foot end, the entire base and load-supporting surfaces being of exposed raw foam whose open cells provide resistance to slippage, the body being deflectable from about 23% to about 27% under the weight of the reclining patient.

2. An auxiliary elevated mattress, as defined in claim 1, rolled into a compact roll and a detachable retaining band containing it in rolled form.

3. A bedding arrangement, comprising, a mattress having a head end and a foot end, an auxiliary elevated mattress extending from the head end and comprising, a wedge-shaped body entirely of open cell synthetic resin foam of which the indentation load deflection (ILD) is within the range from about 20 to about 26 based on the pounds of force for a 25% deflection in pounds force per 50 sq. inches in a sample of a size 15 inches by 15 inches by 4 inches, said body having, extending from a head end to a foot end, a rectangular base surface of which the length is in the range from about 32 inches to about 42 inches, and an uninterrupted load-receiving surface diverging therefrom at an acute angle, a major head end surface having a height from about 6½ to about 5⅞ inches extending from the base surface to the load-bearing surface, and a minor foot end surface having a height not greater than about one-half inch extending between the load-bearing and base surfaces, the base and load-bearing surfaces having substantially the width of the mattress, and the base surface resting on the top surface of the mattress with the head end surface thereof near the head end of the mattress, the length of the load-receiving surface of the auxiliary elevated mattress being such as to support the head, neck and thorax of a patient lying on the mattress with the crease in his buttocks near the foot end, the base and load-supporting surfaces of the auxiliary elevated mattress being of exposed raw foam providing resistance to slippage, a separate loose mattress cover removably enveloping the mattress and auxiliary elevated mattress, the body being deflectable from about 23% to about 27% under the weight of the reclining patient.

* * * * *